US008641443B1

(12) United States Patent
Moussa et al.

(10) Patent No.: US 8,641,443 B1
(45) Date of Patent: Feb. 4, 2014

(54) ELECTRICAL POWER CONNECTOR WITH HANDLE

(75) Inventors: Hamze Moussa, Palm Harbor, FL (US); Encarnacion Rivera, San Pedro Sula (HN); Peter A. Czerner, Plant City, FL (US)

(73) Assignee: Technology Research Corporation, Clearwater, FL (US)

( * ) Notice: Subject to any disclaimer, the term of this patent is extended or adjusted under 35 U.S.C. 154(b) by 21 days.

(21) Appl. No.: 13/543,140

(22) Filed: Jul. 6, 2012

Related U.S. Application Data

(60) Provisional application No. 61/571,956, filed on Jul. 8, 2011.

(51) Int. Cl.
*H01R 13/00* (2006.01)

(52) U.S. Cl.
USPC ..... 439/484

(58) Field of Classification Search
USPC ..... 439/483, 484, 923
See application file for complete search history.

(56) References Cited

U.S. PATENT DOCUMENTS

| | | | | |
|---|---|---|---|---|
| 1,699,722 | A | 1/1929 | Stott | |
| 2,226,385 | A | 12/1940 | Ramsey | |
| 2,507,092 | A | 5/1950 | Cline | |
| 2,722,575 | A | 11/1955 | Dobkins | |
| 5,057,036 | A | 10/1991 | Dickie | |
| 5,454,731 | A | 10/1995 | Dickie | |
| 6,053,762 | A | 4/2000 | Matsumura et al. | |
| 6,736,666 | B2 | 5/2004 | Yu | |
| 7,052,309 | B1 | 5/2006 | Chen | |
| 7,467,953 | B2 * | 12/2008 | Kuo et al. | 439/67 |
| 7,556,524 | B2 * | 7/2009 | Kuo et al. | 439/484 |
| 7,625,230 | B2 * | 12/2009 | Boerner | 439/484 |

* cited by examiner

*Primary Examiner* — Khiem Nguyen
(74) *Attorney, Agent, or Firm* — Frijouf, Rust & Pyle P.A.

(57) ABSTRACT

An improved electrical connector is disclosed for facilitating disconnection an electrical plug. A handle is pivotably mounted to the electrical plug. A distal end of the plug handle extends transversely and outwardly defining opposed arcuate finger receiving regions for accommodating adjacent fingers of the operator for enabling the operator grasp the plug handle to facilitating disconnection an electrical plug. The present invention is equally suitable for use with an electrical receptacle.

20 Claims, 9 Drawing Sheets

ELECTRICAL POWER CONNECTOR WITH HANDLE

CROSS-REFERENCE TO RELATED APPLICATIONS

This application claims benefit of U.S. Patent Provisional application No. 61/571,956 filed Jul. 8, 2011. All subject matter set forth in provisional application No. 61/571,956 filed Jul. 8, 2011 is hereby incorporated by reference into the present application as if fully set forth herein.

BACKGROUND OF THE INVENTION

1. Field of the Invention

This invention relates to electricity and more particularly to an improved handle for extracting an electrical plug from an electrical socket.

2. Background of the Related Art

When electricity became more than a means for lighting and became a common utility for powering other appliances in the early part of the 20th century, the need for a safe and easy means of connection to and disconnection from the power source was identified. In 1904, the original two pin plug and socket was patented. As power requirements increased, electric power technology evolved to produce more sophisticated plugs and sockets. These new connection systems include polarized and grounded plugs and sockets, as well as specially configured designs for a variety of purposes. Twist locking plugs were designed and produced to prevent inadvertent disconnection of the plugs from the sockets. Likewise, plugs and sockets have been developed which limit maximum current loads.

Since the inception of the power plug and socket, disconnecting a plug from a socket has evolved as a basic problem. Too often the disconnection of the plug from the socket is accomplished by pulling on the power cord. Grasping the plug and pulling to remove from the socket or in the case of twist locking systems twisting and pulling to remove from the socket proves to be particularly difficult for the user. In cases where several plugs are closely spaced as in duplex or more particularly in four socket gang boxed systems grasping the plug becomes especially difficult to accomplish.

There have been many in the prior art who have attempted to solve these problems with varying degrees of success. None, however completely satisfies the requirements for a complete solution to the aforestated problem. The following U.S. patents are attempts of the prior art to solve this problem.

U.S. Pat. No. 1,699,722 to Stott discloses an attachment for use in removing an electric plug from its socket or the like. The invention involves the provision of a handle or bail securely attached to the plug and projecting outwardly at the center where it will naturally be in position for anyone to grasp.

U.S. Pat. No. 2,226,385 to Ramsey discloses the construction and mounting of disconnecting switches and the like. The disclosed switch has a switch blade that is movable into and out of contact engagement with a plurality of stationary contact fingers each of which has a small area high pressure contact portion and each of which is individually resilient and prestressed to provide a relatively high contact pressure in the switch closed position without requiring highly accurate alignment of the contact fingers.

U.S. Pat. No. 2,507,092 to Cline discloses plug caps for electrical outlets, and the like and more particularly to plug caps having novel means to remove them from the electrical outlets, and being otherwise particularly constructed so as to prevent the plug cap from being removed from the outlet by pulling on the cord connection, which latter is inserted into the plug cap for connection thereto, through the side thereof, thus preventing the cord wires from being loosened from the plug terminals.

U.S. Pat. No. 2,722,575 to Dobkins discloses improvements in cutout or safety switches for the ignition circuit of a motor vehicle and especially relates to a safety device for farm vehicles, which are driven by an internal combustion engine U.S. Pat. No. 5,057,036 to Dickie discloses a pivotable pull ring permanently attached to a low profile electrical plug by fashioning a locking stub at the attaching ends of the pull ring. Matching lock stub cavities in the electrical plug have "one-way" locking tabs which accept the locking stubs into the locking cavity during assembly, but which block the removal of the locking stub from the locking stub cavity once the locking stub is assembled into the locking stub cavity. The locking tab has a gentle ramp on the outside, to facilitate displacement of the locking tab to allow entry of the locking stub during assembly, but has an abrupt shoulder on the inside to prevent displacement of the locking tab after assembly.

U.S. Pat. No. 5,454,731 to Dickie discloses a molded plastic low profile electrical plug comprising a thin molded plastic main body member, two electrically conductive blade members adapted for insertion into an electrical outlet, and two wire members forming an electrical cord. A removal handle receiving aperture is open to the back face of the main body member. A molded plastic removal handle having a base portion and a handle portion joined in flexible relation to the base portion, is situated with the base portion within the removal handle receiving aperture such that the main body member and the base portion of the removal handle are in interference fit with each other, so as to securely retain the removal handle in the removal handle receiving aperture. The handle portion is flexibly movable between an in-use position and an offset position. When the handle portion is in its in-use position it extends generally perpendicularly outwardly from the back face of the main body member so as to be readily graspable. The resultant line of action of a pulling force transmitted through the molded plastic removal handle is oriented generally parallel to the longitudinal axes of the two electrically conductive blade members, thus having an effective point of application located substantially midway between the two electrically conductive blade members. In this manner, the pulling force is distributed relatively evenly between the two electrically conductive blade members, to thereby facilitate ready removal of the electrical plug from an electrical outlet.

U.S. Pat. No. 6,053,762 to Matsumura, et al discloses a terminal fitting structure of a service plug provided with a plug body provided with short-circuiting terminals. A turning shaft is provided to the plug body so that the turning shaft is perpendicular to the respective fitting centers of the short-circuiting terminals, and a lever coupled to the plug body via the turning shaft so that the lever can be turned.

U.S. Pat. No. 6,736,666 to Yu discloses electrical plugs capable of being easily removed from their associated receptacles with the aid of a pull ring. This improved pull ring is either pulled or pushed only in the direction that is perpendicular to the prong side of an electrical plug whereby making the storage and operation of the pull ring much easier to operate than the typical pull-ringed electrical plug arrangements that are currently available.

U.S. Pat. No. 7,052,309 to Chen discloses an electric plug including two locating blocks aligned at two sides of the housing thereof to pivotally hold a substantially C-shaped pull ring. The pull ring has two pivot holes aligned at the ends thereof and respectively pivotally connected to the locating blocks by a respective pivot bolt that has a head stopped outside the respective pivot hole. The heads of the pivot bolts each have a diameter greater than that of the pivot holes so as to prevent disconnection of the pull ring from the housing.

Although the aforementioned prior art have contributed to the development of the art of securing an object to a support member, none of these prior art patents have solved the needs of this art.

Therefore, it is an object of the present invention to provide an improved electrical power plug for enabling the safe efficient disconnection from an electrical power receptacle.

Another object of this invention is to provide an improved electrical power plug having a grasping device to enable safe efficient disconnection from an electrical power receptacle.

Another object of this invention is to provide an improved electrical power plug having a rigid grasping device to enable safe efficient twisting and disconnection from a twist locking electrical power receptacle Another object of this invention is to provide an improved electrical disconnecting apparatus that is adaptable to an electrical receptacle.

Another object of this invention is to provide an improved electrical disconnecting apparatus that utilizes a minimum number of metallic parts.

Another object of this invention is to provide an improved electrical disconnecting apparatus that utilizes a nonconductive polymeric material to reduce shock hazard.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved electrical connector for facilitating disconnection by an operator comprising an electrical plug having a plurality of electrical blades terminals extending from the electrical plug. A plug handle extends from a proximal end to a distal end. The proximal end of the plug handle is pivotably mounted to the electrical plug. The distal end of the plug handle extends transversely and outwardly defining opposed arcuate finger receiving regions for accommodating adjacent fingers of the operator for enabling the operator grasp the plug handle to separate the electrical plug from the electrical socket.

In more specific embodiment, the plug handle is formed from a non-conducting polymeric material. The electrical plug includes a plug body defining a plug recess. The plug handle is pivotably mounted for movement between a storage position and a grasping position. A plug recess receives the plug handle when the plug handle is pivoted into a storage position. A plug pivot pin extends through the plug body into the plug recess for pivotably mounding the plug handle. The electrical plug includes a plug body defines an outer plug body arc. The distal end of the handle defines a major arc commensurate with the outer plug body arc of the plug body.

In another specific embodiment, the plug handle has a generally T-shape with the bottom of the T defining the proximal end and with the transverse top portion the distal end. The distal end of the plug handle defines a major arc. The proximal end of the plug handle is connected to the distal end with opposed symmetric minor arcs interconnecting the proximal end to the major arc. The proximal end of the plug handle is connected to the distal end with opposed symmetric minor arcs interconnecting the proximal end to the major arc. The minor arcs define the opposed arcuate finger receiving regions for accommodating adjacent fingers of the operator.

In another embodiment, the invention is incorporated into an improved electrical connector for facilitating disconnection by an operator comprising an electrical receptacle having a plurality of electrical blades receivers defined within the electrical receptacle. A receptacle handle extends from a proximal end to a distal end. The proximal end of the receptacle handle is pivotably mounted to the electrical receptacle. The distal end of the receptacle handle extends transversely and outwardly defining opposed arcuate finger receiving regions for accommodating adjacent fingers of the operator for enabling the operator grasp the receptacle handle to separate the electrical receptacle from an electrical connection.

In more specific embodiment, the receptacle handle is formed from a non-conducting polymeric material. The electrical receptacle includes a receptacle body defining a receptacle recess. The receptacle handle is pivotably mounted for movement between a storage position and a grasping position. A receptacle recess receives the receptacle handle when the receptacle handle is pivoted into a storage position. A receptacle pivot pin extends through the receptacle body into the receptacle recess for pivotably mounding the receptacle handle. The electrical receptacle includes a receptacle body defines an outer receptacle body arc. The distal end of the handle defines a major arc commensurate with the outer receptacle body arc of the receptacle body.

In another specific embodiment, the receptacle handle has a generally T-shape with the bottom of the T defining the proximal end and with the transverse top portion the distal end. The distal end of the receptacle handle defines a major arc. The proximal end of the receptacle handle is connected to the distal end with opposed symmetric minor arcs interconnecting the proximal end to the major arc. The proximal end of the receptacle handle is connected to the distal end with opposed symmetric minor arcs interconnecting the proximal end to the major arc. The minor arcs define the opposed arcuate finger receiving regions for accommodating adjacent fingers of the operator.

In still a further embodiment, the invention is incorporated into an improved electrical connector for facilitating disconnection by an operator comprising an electrical plug having a plurality of electrical blades extending from the electrical plug. A plug handle extends from a proximal end to a distal end. The proximal end of the plug handle is pivotably mounted to the electrical plug. The distal end of the plug handle extends transversely and outwardly defining opposed arcuate finger receiving regions for accommodating adjacent fingers of the operator.

An electrical receptacle has a plurality of electrical blades receivers defined within the electrical receptacle. A receptacle handle extends from a proximal end to a distal end. The proximal end of the receptacle handle is pivotably mounted to the electrical receptacle. The distal end of the receptacle handle extends transversely and outwardly defining opposed arcuate finger receiving regions for accommodating adjacent fingers of the operator.

The electrical plug handle and the electrical receptacle handle enable the operator grasp the electrical plug handle and the electrical receptacle handle with adjacent fingers of opposed hands to separate the electrical plug from the electrical receptacle.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
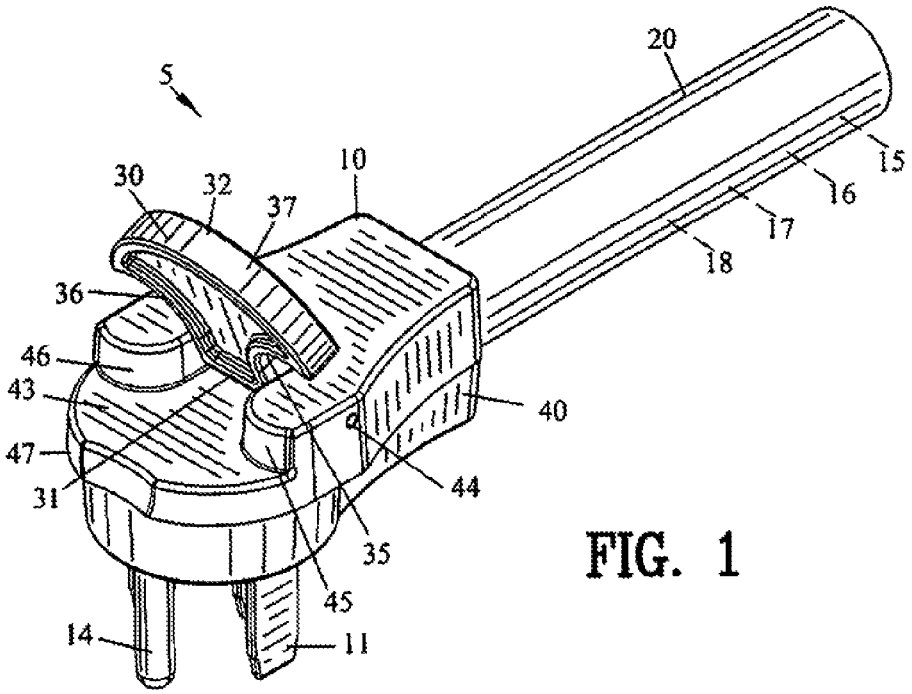
FIG. 1 is a top isometric view of a first embodiment of an improved electrical plug incorporating the present invention with a plug handle located in a grasping.
Figure 2:
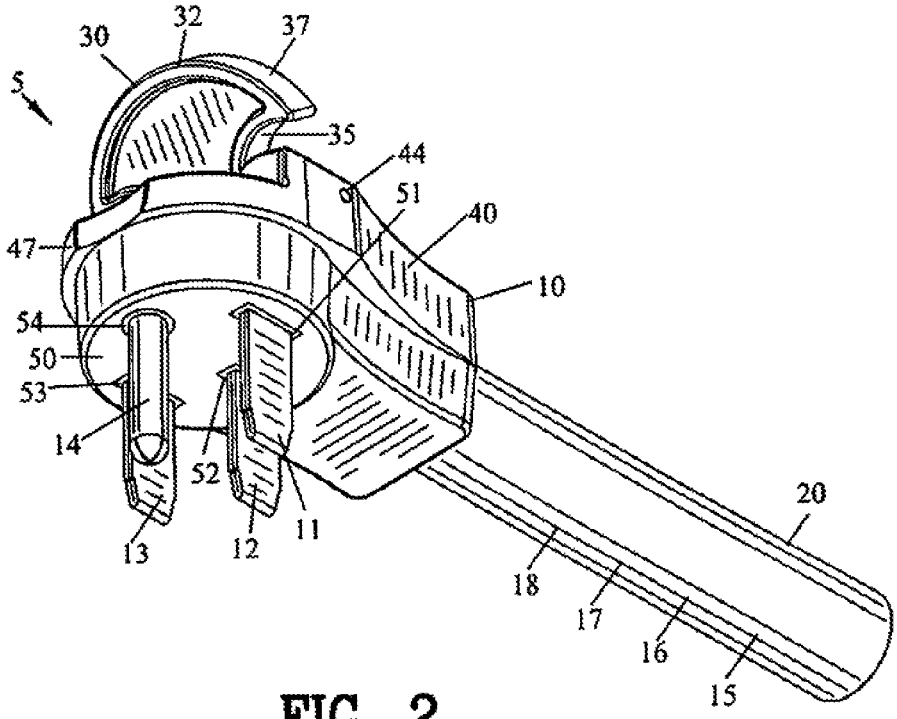
FIG. 2 is a bottom isometric view of the improved electrical plug of FIG. 1.

FIGS. 1-4 are various view of a first embodiment of an improved electrical connector 5 of the present invention for facilitating disconnection by an operator. The improved electrical connector 5 comprises an electrical plug 10 having a plurality of electrical terminals 11-14 extending from the electrical plug 10. The electrical terminals 11-13 are electrical blade terminals whereas the electrical terminal 14 is a ground terminal. The electrical plug 10 is suitable for use with 50 ampere electrical service.

The plurality of electrical blades terminals 11-14 are connected to a plurality of conductors 15-18 internal an electrical cable 20. The connection of the plurality of electrical blades terminals 11-14 to the plurality of conductors 15-18 may be accomplished by swaging, welding, soldering or other conventional means as should be well known to those skilled in the art.

The electrical plug 10 includes a plug handle 30 extending between a proximal end 31 and a distal end 32. The proximal end 21 of the plug handle 30 is pivotably mounted to the electrical plug 10 by a plug pivot pin 44.

Figure 4:
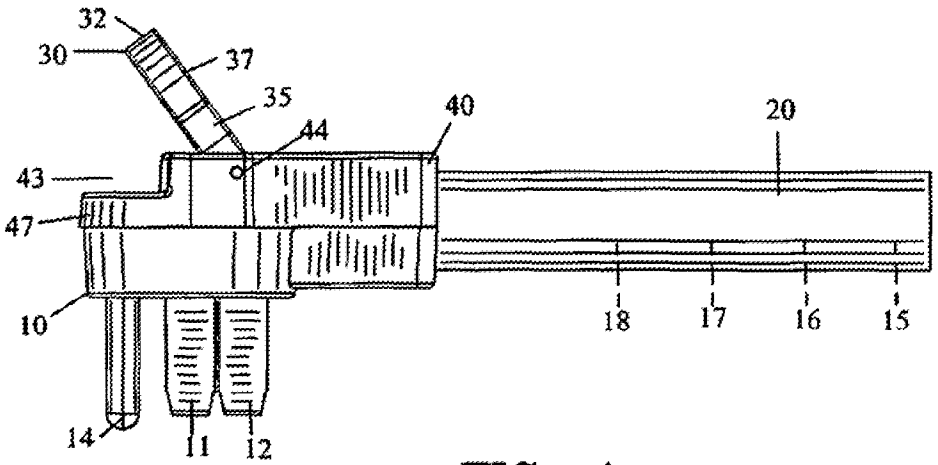
FIG. 4 is a side view of FIG. 3.
Figure 3:
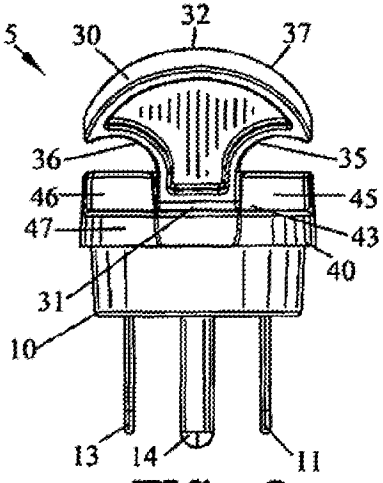
FIG. 3 is a front view of the improved electrical plug of FIGS. 1 and 2.

FIGS. 3-4 illustrate the plug handle 10 pivotably mounted into a grasping position. When the plug handle 10 is disposed in the grasping position, an operator may grasp the plug handle 30 to separate the electrical plug 10 from an electrical receptacle.

Figure 6:
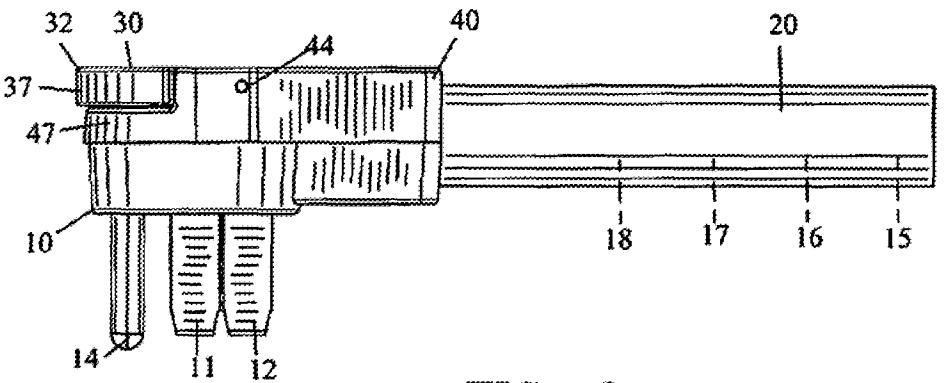
FIG. 6 is a side view of FIG. 5.
Figure 5:
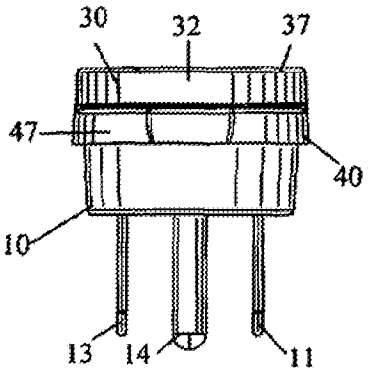
FIG. 5 is a front view similar to FIG. 3 with the plug handle located in a storage position.

FIGS. 5-6 illustrate the plug handle 10 pivotably mounted into a storage position. When the plug handle 10 is disposed in the storage position, the plug handle 30 is moved into a recess 43 defined in a plug body 40.

Figure 7:
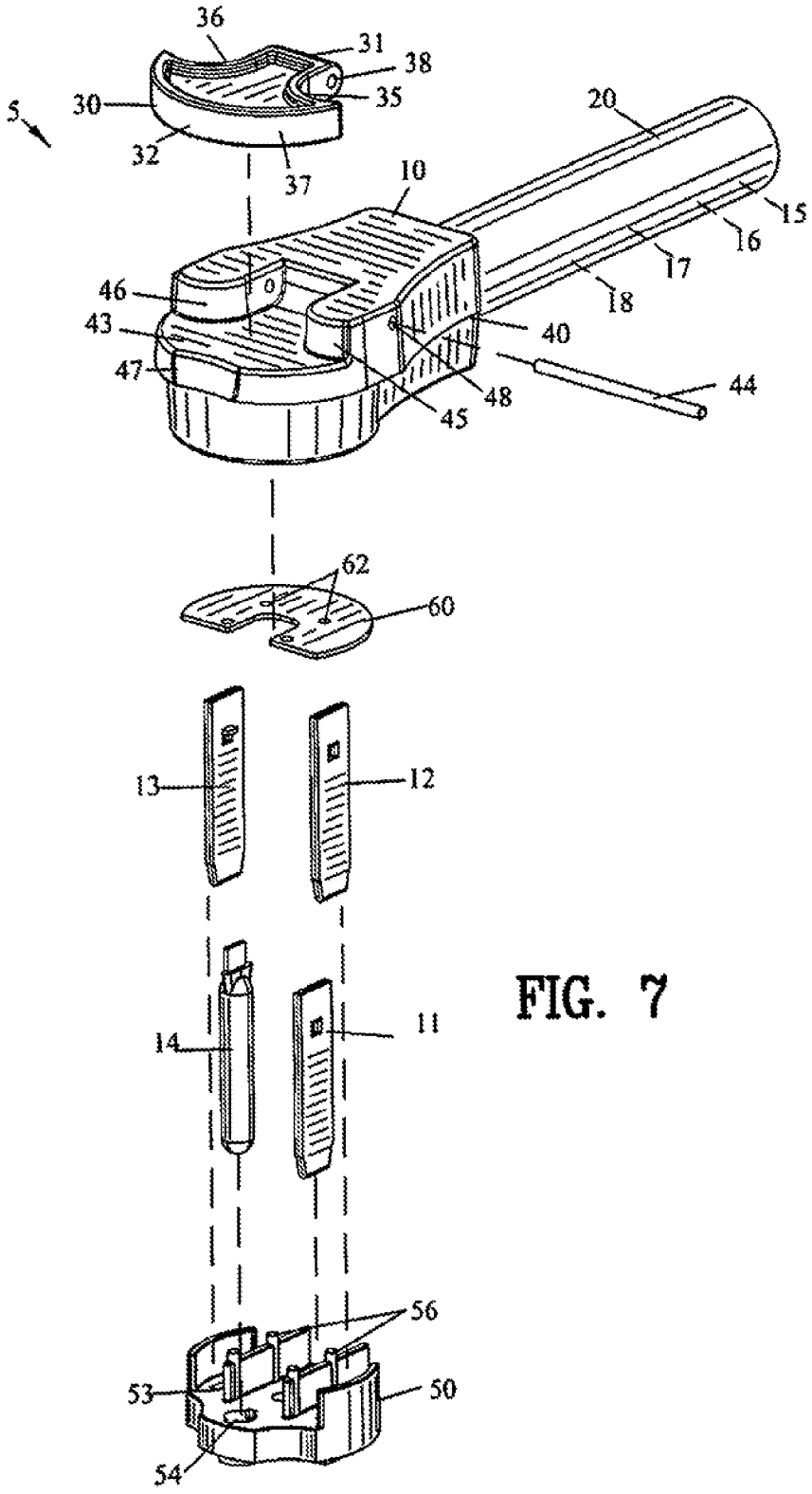
FIG. 7 is an exploded view of the improved electrical plug of FIGS. 1-7.
Figure 8:
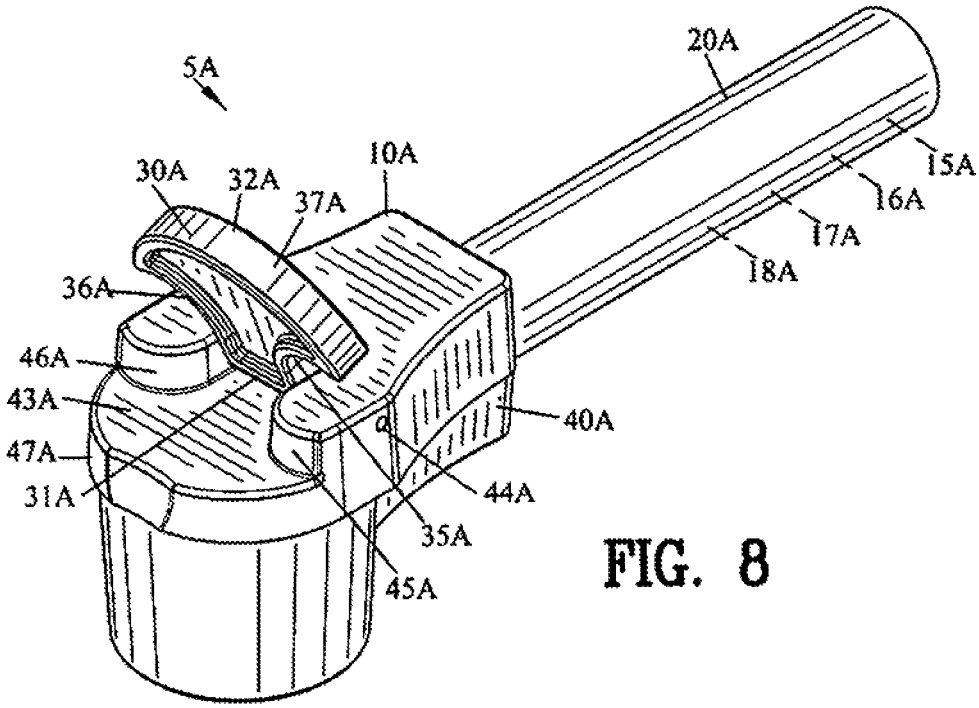
FIG. 8 is a top isometric view of second embodiment of an improved electrical receptacle of the present invention with a receptacle handle located in a grasping.
Figure 9:
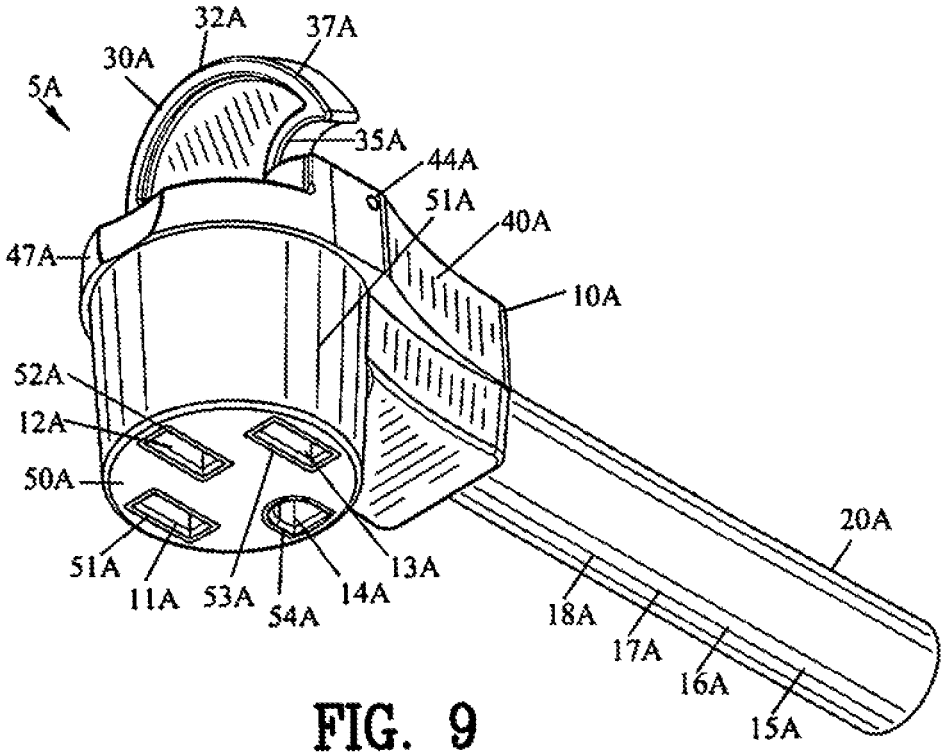
FIG. 9 is a bottom isometric view of the improved electrical receptacle of FIG. 8.

FIG. 7 is an exploded view of the improved electrical plug 10 of FIGS. 1-7. The plug handle 30 extends between a proximal end 31 and a distal end 32. The plug handle 30 is in the form of a general T-shape with the proximal end 31 located at the bottom of the T-shape and with the distal end 32 located at the top of the T-shape. A first and a second minor arc 35 and 36 interconnect the proximal end 31 to the distal end 32 of the plug handle 30. The first and second minor arc 35 and 36 define the opposed arcuate finger receiving regions for accommodating adjacent fingers of an operator. The distal end 32 of the plug handle 30 defines a major arc 37. The first and second minor arcs 35 and 36 interconnect with the major arc 37 to form the generally T-shape plug handle 30.

The plug handle 10 is pivotably mounted to the plug body 40 by the plug pivot pin 44. The recess 43 with in the plug body 40 defines a first minor arc 45 and a second minor arc 46. The first minor arc 45 asymmetric and a mirror image of the second minor arc 46. The outer periphery of the plug body 40 defines an outer arc 47. The first and second minor arcs 45 and 46 of the recess 43 are selected to conform with the first and second minor arcs 35 and 36 of the plug handle 30 to provide a substantially continuous upper surface to the plug body 40 when the plug handle 30 is pivoted into the storage position. The major arc 37 of the plug handle 30 is commensurate with the outer arc 47 of the plug body 40 to provide a substantially continuous outer surface to the plug body 40.

A plug housing 50 is provided with apertures 51-54 for receiving the electrical blade terminals 11-13 in the ground terminal 14. The plug housing 50 includes alignment projections 56 for aligning with a plug housing cover 60 having alignment apertures 62.

The electrical plug 10 may be fabricated by connecting the conductors 15-18 to the electrical terminals 11-14 as heretofore described. The electrical terminals 11-14 are inserted within the plug housing 50 and the plug housing cover 60 is installed thereon. Thereafter, the plug body 40 is molded about the plug housing 50, the plug housing cover 60 and the cable 20 to form the electrical connector 5. The recess 43 is formed within the plug body 40 during the molding process. The plug body 40 is formed from a non-conductive polymeric material.

The plug handle 30 is formed separately from a nonconductive polymeric material. The plug handle 30 is aligned within the recess 43 can be plug pivot pin 44 is inserted through a pin aperture 48 within the plug body 40 into extend through a pivot aperture 38 defined in the plug handle 30. The plug pivot pin 44 is frictionally retained within the pin aperture 48.

FIGS. 8-11 are various view of a second embodiment of an improved electrical connector 5A of the present invention for facilitating disconnection by an operator. The improved electrical connector 5A comprises an electrical receptacle 1A0 having a plurality of electrical receivers 11A-14A defined within the electrical receptacle 10A. The electrical receivers 11A-13A are dimension to receive electrical blade terminals 11-13 whereas the electrical receiver 14A is dimension to receive a ground terminal 14.

The plurality of electrical blades terminals 11A-14A are connected to a plurality of conductors 15A-18A internal an electrical cable 20A as should be well known to those skilled in the art.

The electrical receptacle 10A includes a receptacle handle 30A extending between a proximal end 31A and a distal end 32A. The proximal end 21A of the receptacle handle 30A is pivotably mounted to the electrical receptacle 10A by a receptacle pivot pin 44A.

Figure 11:
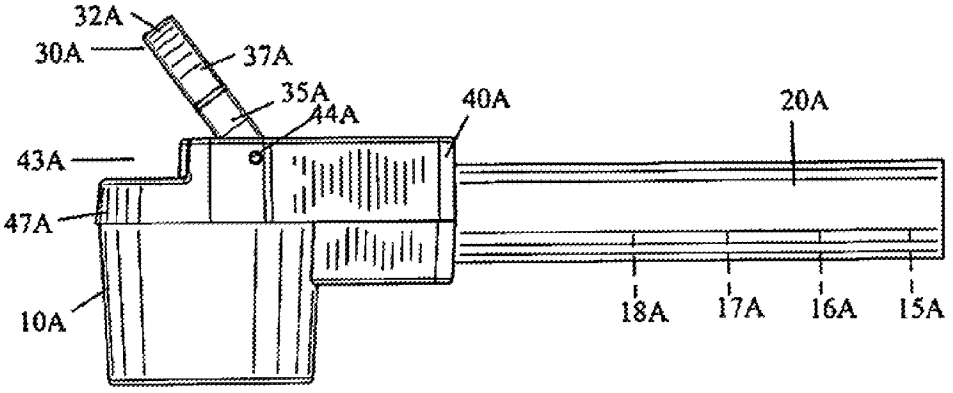
FIG. 11 is a side view of FIG. 10.
Figure 10:
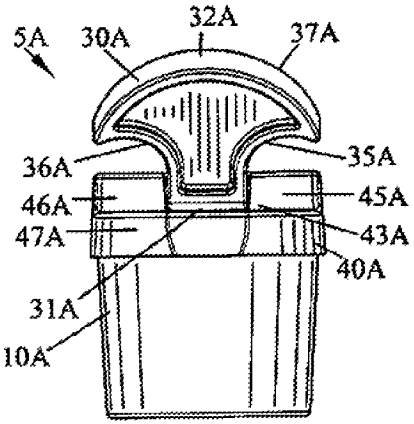
FIG. 10 is a front view of the improved electrical receptacle of FIGS. 8 and 9.

FIGS. 10-11 illustrate the receptacle handle 10A pivotably mounted into a grasping position for enabling an operator may grasp the receptacle handle 30A to separate the electrical receptacle 10A from an electrical plug.

Figure 13:
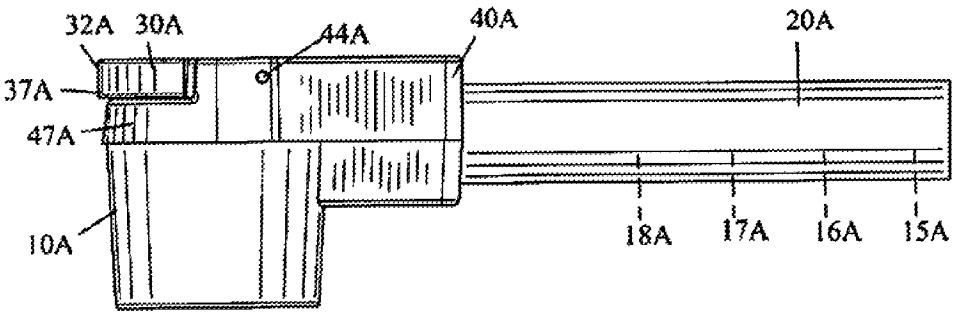
FIG. 13 is a side view of FIG. 12.
Figure 12:
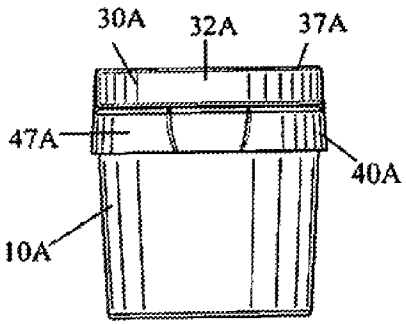
FIG. 12 is a front view similar to FIG. 10 with the receptacle handle located in a storage position.

FIGS. 12-13 illustrate the receptacle handle 10A pivotably mounted into a storage position. When the receptacle handle 10A is disposed in the storage position, the receptacle handle 30A is moved into a recess 43A defined in a receptacle body 40S.

Figure 14:
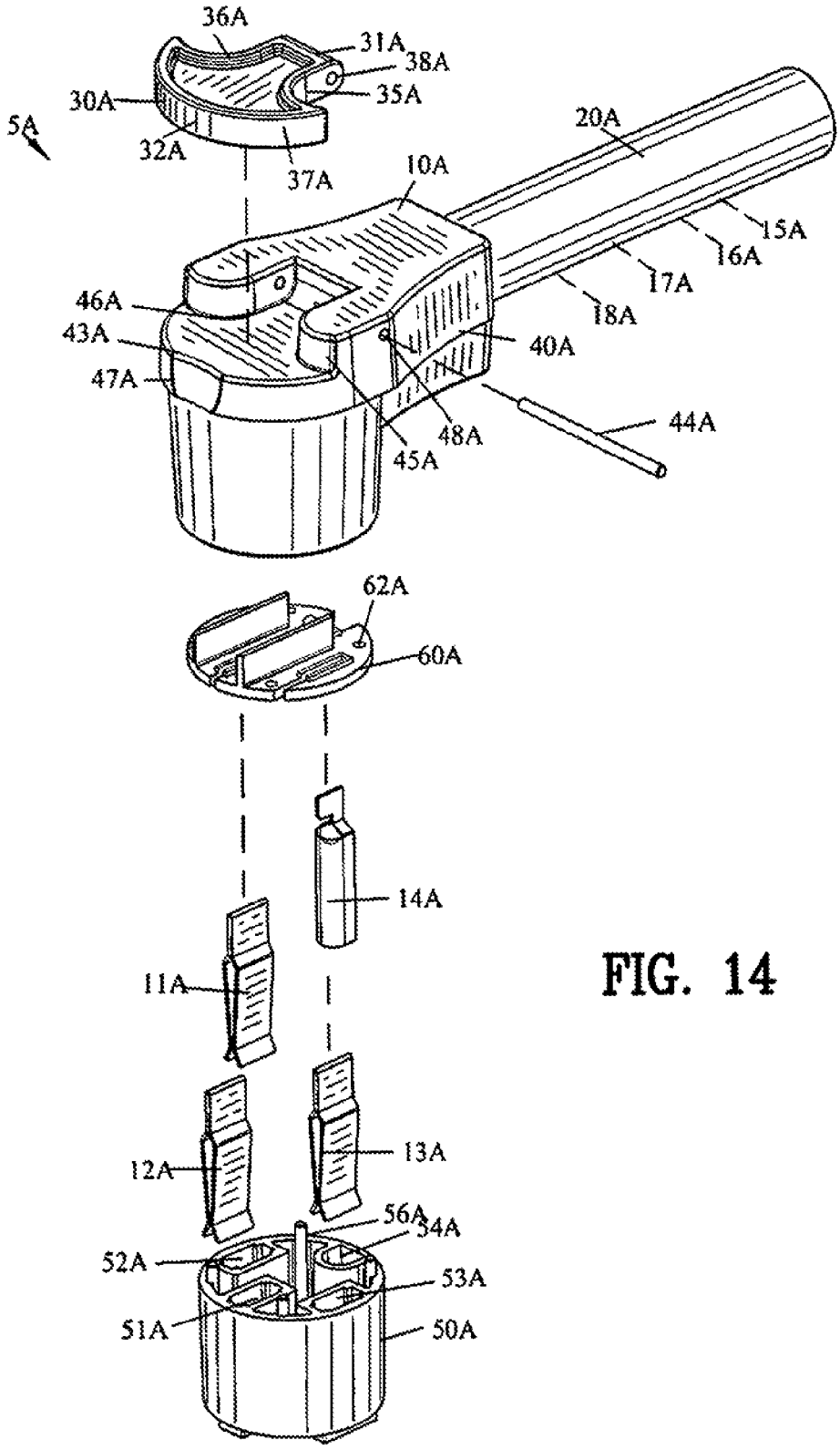
FIG. 14 is an exploded view of the improved electrical receptacle of FIGS. 8-13.

FIG. 14 is an exploded view of the improved electrical receptacle 10A of FIGS. 8-13. The receptacle handle 30A extends between a proximal end 31A and a distal end 32A. The receptacle handle 30A is in the form of a general T-shape with the proximal end 31A located at the bottom of the T-shape and with the distal end 32A located at the top of the T-shape. A first and a second minor arc 35A and 36S interconnect the proximal end 31A to the distal end 32A of the receptacle handle 30A. The first and second minor arc 35A and 36A define the opposed arcuate finger receiving regions for accommodating adjacent fingers of an operator. The distal end 32A of the receptacle handle 30A defines a major arc 37A. The first and second minor arcs 35A and 36A interconnect with the major arc 37A to form the generally T-shape receptacle handle 30A.

The receptacle handle 10A is pivotably mounted to the receptacle body 40A by the receptacle pivot pin 44A. The recess 43A with in the receptacle body 40 defines a first minor arc 4A5 and a second minor arc 46A. The first minor arc 45A asymmetric and a mirror image of the second minor arc 46A. The outer periphery of the receptacle body 40A defines an outer arc 47A. The first and second minor arcs 45A and 46A of the recess 43A are selected to conform with the first and second minor arcs 35A and 36A of the receptacle handle 30A to provide a substantially continuous upper surface to the receptacle body 40A when the receptacle handle 30A is pivoted into the storage position. The major arc 37A of the receptacle handle 30A is commensurate with the outer arc 47A of the receptacle body 40A to provide a substantially continuous outer surface to the receptacle body 40A.

A receptacle housing 50A is provided with apertures 51-54 for receiving the electrical terminal receivers 11A-13A in the ground terminal receiver 14A. The receptacle housing 50 includes alignment projections 56A for aligning with a receptacle housing cover 60A having alignment apertures 62.

The electrical receptacle 10 may be fabricated by connecting the conductors 15A-18A to the electrical terminal receivers 11A-14A as heretofore described. The electrical terminal receivers 11A-14A are inserted within the receptacle housing 50A and the receptacle housing cover 60A is installed thereon. Thereafter, the receptacle body 40A is molded about the receptacle housing 50A, the receptacle housing cover 60A and the cable 20A to form the electrical connector 5A. The recess 43A is formed within the receptacle body 40A during the molding process. The receptacle body 40A is formed from a non-conductive polymeric material.

The receptacle handle 30A is formed separately from a nonconductive polymeric material. The receptacle handle 30A is aligned within the recess 43A can be receptacle pivot pin 44A is inserted through a pin aperture 48A within the receptacle body 40A into extend through a pivot aperture 38A defined in the receptacle handle 30A. The receptacle pivot pin 44A is frictionally retained within the pin aperture 48A.

Figure 15:
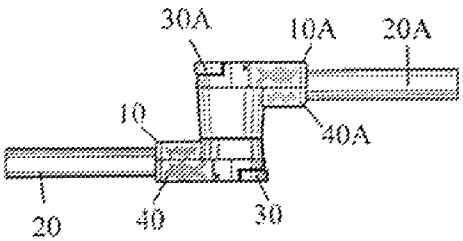
FIG. 15 is a side view of the improved electrical plug of FIGS. 1-7 inserted within the improved electrical receptacle of FIGS. 8-13 with the plug handle and the receptacle handle located in storage positions.

FIG. 15 is a side view of the improved electrical plug 10 of FIGS. 1-7 inserted within the improved electrical receptacle 10A of FIGS. 8-13 with the plug handle 30 and the receptacle handle 30A located in storage positions.

Figure 16:
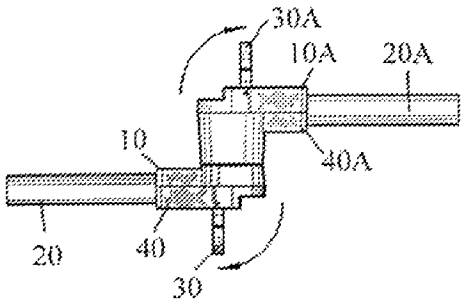
FIG. 16 is a side view similar to FIG. 15 with the plug handle and the receptacle handle located in grasping positions.

FIG. 16 is a side view similar to FIG. 15 with the plug handle 30 and the receptacle handle 30A located in grasping positions.

Figure 17:
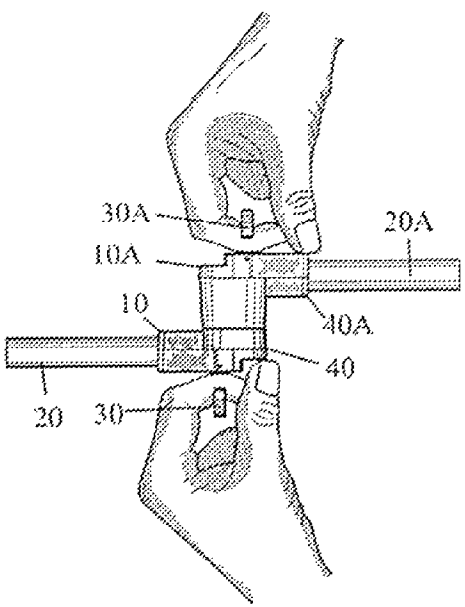
FIG. 17 the side view similar to FIG. 16 illustrating an operator grasping the plug handle and the receptacle handle with opposite hands.

FIG. 17 the side view similar to FIG. 16 illustrating an operator grasping the plug handle 30 and the receptacle handle 30A with opposite hands.

Figure 18:
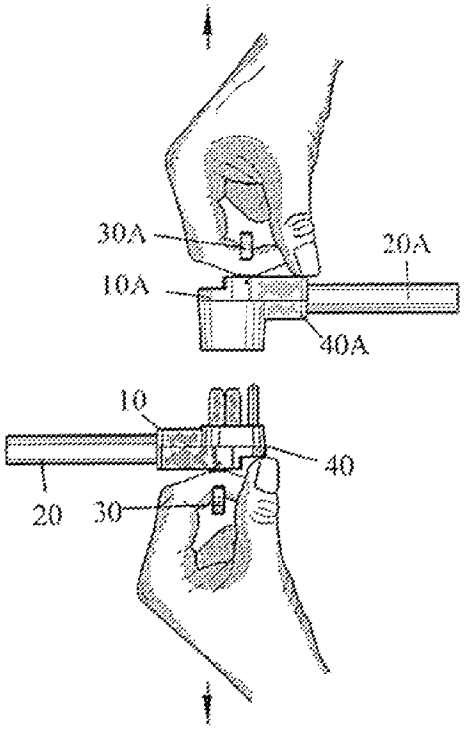
FIG. 18 the side view similar to FIG. 17 illustrating the operator separating the electrical plug from the electrical receptacle.

FIG. 18 the side view similar to FIG. 17 illustrating the operator separating the electrical plug 30 from the electrical receptacle 30A.

Figure 19:
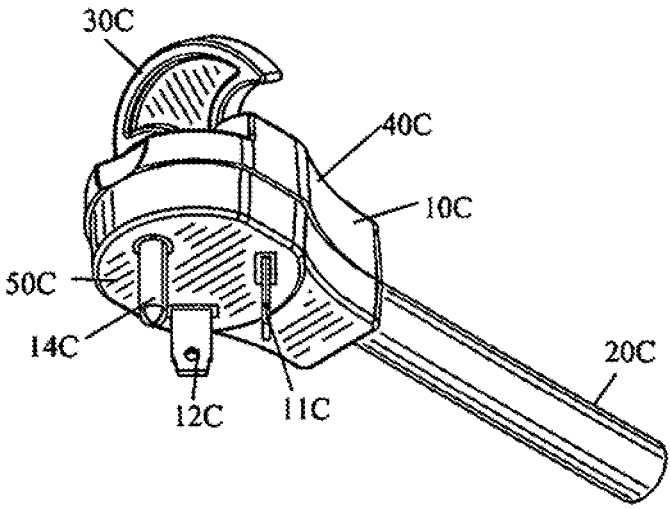
FIG. 19 is a top isometric view of a third embodiment of an improved electrical plug incorporating the present invention.

FIG. 19 is a top isometric view of a third embodiment of an improved electrical plug 10C incorporating the present invention. The improved electrical plug 10C is suitable for use with 30 ampere electrical service.

Figure 20:
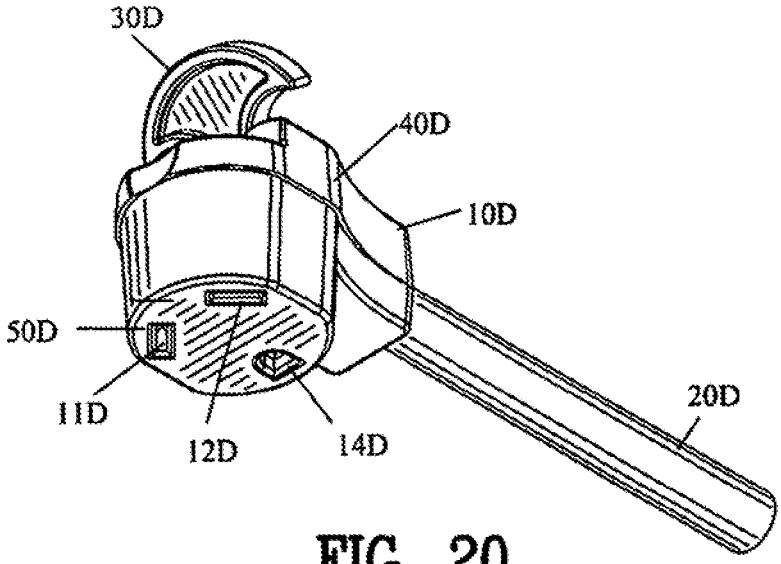
FIG. 20 is a bottom isometric view of a fourth embodiment of an improved electrical receptacle.

FIG. 20 is a bottom isometric view of a fourth embodiment of an improved electrical receptacle 10D. The improved electrical receptacle 10D is suitable for use with 30 ampere electrical service.

Figure 21:
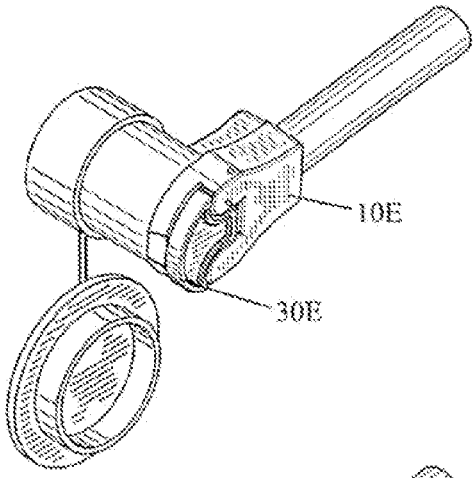
FIG. 21 is a top isometric view of a fifth embodiment of an improved electrical receptacle of the present invention inserted into a plug.

FIG. 21 is a top isometric view of a fifth embodiment of an improved electrical receptacle 10E of the present invention inserted into a plug. The electrical receptacle 10E is suitable for use as a marine grade twist lock.

Figure 22:
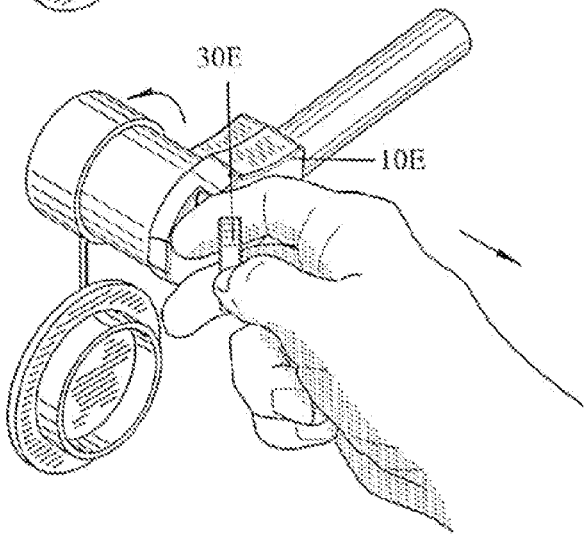
FIG. 22 is a view similar to FIG. 21 with an operator grasping the receptacle handle.

FIG. 22 is a view similar to FIG. 21 with an operator grasping the receptacle handle 30E of the electrical receptacle 10E.

Figure 23:
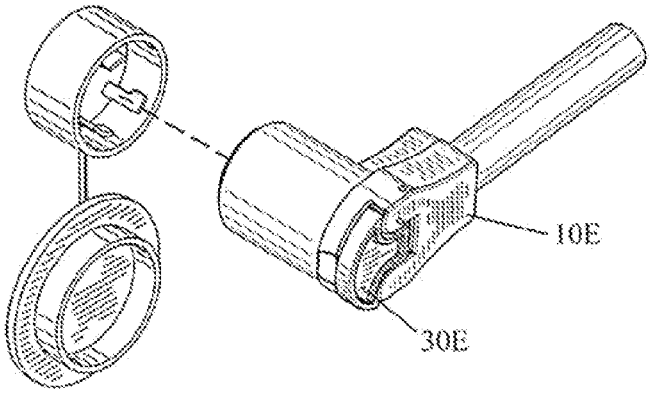
FIG. 23 the side view similar to FIG. 22 electrical receptacle separated from the electrical plug.

FIG. 23 the side view similar to FIG. 22 electrical receptacle 10E separated from the electrical plug.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved electrical connector for facilitating disconnection from an electrical socket by an operator, comprising:

an electrical plug having a plurality of electrical blades terminals extending from said electrical plug;

a plug handle extending from a proximal end to a distal end;

said proximal end of said plug handle being pivotably mounted to said electrical plug; and said distal end of said plug handle extending transversely and outwardly defining opposed arcuate finger receiving regions for accommodating adjacent fingers of the operator for enabling the operator to grasp said plug handle to separate said electrical plug from the electrical socket.

2. An improved electrical connector as set forth in claim 1, wherein said plug handle is formed from a nonconducting polymeric material.

3. An improved electrical connector as set forth in claim 1, wherein said plug handle is pivotably mounted for movement between a storage position and a grasping position.

4. An improved electrical connector as set forth in claim 1, wherein said electrical plug includes a plug body defining a plug recess;

said plug handle being pivotably mounted for movement between a storage position and a grasping position; and a plug recess receiving said plug handle when said plug handle is pivoted into said storage position.

5. An improved electrical connector as set forth in claim 1, wherein said electrical plug includes a plug body defining a plug recess; and a plug pivot pin extending through said plug body into said plug recess for pivotably mounding said plug handle.

6. An improved electrical connector as set forth in claim 1, wherein said electrical plug includes a plug body defines an outer plug body arc; and said distal end of said handle defining a major arc commensurate with said outer plug body arc of said plug body.

7. An improved electrical connector as set forth in claim 1, wherein said electrical plug includes a plug body defines an outer plug body arc; and said distal end of said handle defining a major arc commensurate with said outer plug body arc of said plug body.

8. An improved electrical connector as set forth in claim 1, wherein said plug handle has a generally T-shape with the bottom of the T defining said proximal end and with said transverse top portion said distal end.

9. An improved electrical connector as set forth in claim 1, wherein said distal end of said plug handle defines a major arc; and said proximal end of said plug handle being connected to said distal end with opposed symmetric minor arcs interconnecting said proximal end to said major arc.

10. An improved electrical connector as set forth in claim 1, wherein said distal end of said plug handle defines a major arc;

said proximal end of said plug handle being connected to said distal end with opposed symmetric minor arcs interconnecting said proximal end to said major arc; and said minor arcs defining said opposed arcuate finger receiving regions for accommodating adjacent fingers of the operator.

11. An improved electrical connector for facilitating disconnection from an electrical plug by an operator, comprising:

an electrical receptacle having a plurality of electrical blades receivers defined within said electrical receptacle;

a receptacle handle extending from a proximal end to a distal end;

said proximal end of said receptacle handle being pivotably mounted to said electrical receptacle; and said distal end of said receptacle handle extending transversely and outwardly defining opposed arcuate finger receiving regions for accommodating adjacent fingers of the operator for enabling the operator to grasp said receptacle handle to separate said electrical receptacle from the electrical plug.

12. An improved electrical connector as set forth in claim 11, wherein said receptacle handle is formed from a nonconducting polymeric material.

13. An improved electrical connector as set forth in claim 11, wherein said receptacle handle is pivotably mounted for movement between a storage position and a grasping position.

14. An improved electrical connector as set forth in claim 11, wherein said electrical receptacle includes a receptacle body defining a receptacle recess;

said receptacle handle being pivotably mounted for movement between a storage position and a grasping position; and a receptacle recess receiving said receptacle handle when said receptacle handle is pivoted into a storage position.

15. An improved electrical connector as set forth in claim 11, wherein said electrical receptacle includes a receptacle body defining a receptacle recess; and a receptacle pivot pin extending through said receptacle body into said receptacle recess for pivotably mounding said receptacle handle.

16. An improved electrical connector as set forth in claim 11, wherein said electrical receptacle includes a receptacle body defines an outer receptacle body arc; and said distal end of said handle defining a major arc commensurate with said outer receptacle body arc of said receptacle body.

17. An improved electrical connector as set forth in claim 11, wherein said electrical receptacle includes a receptacle body defines an outer receptacle body arc; and said distal end of said handle defining a major arc commensurate with said outer receptacle body arc of said receptacle body.

18. An improved electrical connector as set forth in claim 11, wherein said receptacle handle has a generally T-shape with the bottom of the T defining said proximal end and with said transverse top portion said distal end.

19. An improved electrical connector as set forth in claim 11, wherein said distal end of said receptacle handle defines a major arc; and said proximal end of said receptacle handle being connected to said distal end with opposed symmetric minor arcs interconnecting said proximal end to said major arc.

20. An improved electrical connector as set forth in claim 11, wherein said distal end of said receptacle handle defines a major arc;

said proximal end of said receptacle handle being connected to said distal end with opposed symmetric minor arcs interconnecting said proximal end to said major arc; and said minor arcs defining said opposed arcuate finger receiving regions for accommodating adjacent fingers of the operator.

* * * * *